US007452311B2

(12) United States Patent
Barnes et al.

(10) Patent No.: US 7,452,311 B2
(45) Date of Patent: Nov. 18, 2008

(54) EXERCISE MACHINE WITH DUAL FULCRUM ARTICULATED FORCE LEVER

(75) Inventors: Neal P. Barnes, Medina, MN (US); Karl V. Vaught, Evansville, IN (US); Ross A. Mackert, St. Louis Park, MN (US); Jeff L. Freedman, Cumming, GA (US)

(73) Assignee: Endeavor Design, Inc., Hamel, MN (US)

( * ) Notice: Subject to any disclaimer, the term of this patent is extended or adjusted under 35 U.S.C. 154(b) by 86 days.

(21) Appl. No.: 11/413,851

(22) Filed: Apr. 27, 2006

(65) Prior Publication Data

US 2006/0252613 A1 Nov. 9, 2006

Related U.S. Application Data

(60) Provisional application No. 60/677,575, filed on May 4, 2005.

(51) Int. Cl.
*A63B 21/068* (2006.01)

(52) U.S. Cl. ..... 482/96; 482/72; 482/97; 482/137; 482/138; 482/142

(58) Field of Classification Search ..... 482/72, 482/92–100, 137–139, 142
See application file for complete search history.

(56) References Cited

U.S. PATENT DOCUMENTS

| | | | | | |
|---|---|---|---|---|---|
| 248,121 | A * | 10/1881 | Tuttle | 482/96 |
| 3,638,941 | A * | 2/1972 | Kulkens | 482/113 |
| 4,183,520 | A * | 1/1980 | Chase | 482/112 |
| 4,627,616 | A * | 12/1986 | Kauffman | 482/96 |
| 5,492,518 | A * | 2/1996 | Measom | 482/96 |
| 5,549,533 | A * | 8/1996 | Olson et al. | 482/137 |
| 5,643,147 | A * | 7/1997 | Huang | 482/72 |
| 5,669,865 | A | 9/1997 | Gordon | |
| 5,674,161 | A | 10/1997 | Lin | |
| 5,690,593 | A | 11/1997 | Huang | |
| 5,711,749 | A | 1/1998 | Miller | |
| 5,722,918 | A | 3/1998 | Lee | |
| 5,769,766 | A | 6/1998 | Huang | |
| 5,830,115 | A * | 11/1998 | Chen | 482/96 |
| 6,302,833 | B1 * | 10/2001 | Ellis et al. | 482/100 |
| 6,641,509 | B1 * | 11/2003 | Chen | 482/94 |
| 6,659,919 | B2 * | 12/2003 | Deola | 482/99 |

(Continued)

*Primary Examiner*—LoAn H. Thanh
*Assistant Examiner*—Victor K Hwang
(74) *Attorney, Agent, or Firm*—Pauly, Devries Smith & Deffner

(57) ABSTRACT

An exercise machine includes a dual fulcrum articulated force lever connected to a machine frame. The articulated force lever includes a first force arm and a second force arm. A fixed end of the second force arm is pivotally connected to the frame at a first fulcrum. A movable end of the second force arm is pivotally connected to a first end of the first force arm for pivoting of the first force arm about a second fulcrum. A resistance load is attached intermediately to the first force arm. A handle section is connected to the first end of the first force arm opposite the pivot connection to the second force arm. Movement of the handle section in one direction rotates the first force arm and the second force arm together about the first fulcrum against the load. Movement of the handle section in an opposite direction rotates the first force arm about the second fulcrum against the load.

3 Claims, 13 Drawing Sheets

U.S. PATENT DOCUMENTS

| | | | | |
|---|---|---|---|---|
| 6,752,748 | B1 | 6/2004 | Scotti | |
| 6,971,978 | B2 * | 12/2005 | Hyder | 482/142 |
| 2004/0033871 | A1 * | 2/2004 | Ma | 482/142 |
| 2006/0025288 | A1 * | 2/2006 | Patterson | 482/112 |
| 2008/0051265 | A1 * | 2/2008 | Webber | 482/99 |

* cited by examiner

EXERCISE MACHINE WITH DUAL FULCRUM ARTICULATED FORCE LEVER

CROSS REFERENCE TO RELATED APPLICATIONS

This application claims the benefit of U.S. provisional patent application Ser. No. 60/677,575 filed May 4, 2005.

SUMMARY OF THE INVENTION

An exercise machine is disclosed for use by an exercising person moving a handle bar against a load. The machine includes a dual fulcrum articulated force lever connected to a machine frame. The articulated force lever includes a first force arm and a second force arm. A fixed end of the second force arm is pivotally connected to the frame at a first fulcrum. A movable end of the second force arm is connected at a second pivot to a first end of the first force arm for pivoting about a second fulcrum. A resistance load is attached intermediately to the first force arm.

A handle section is connected to the first end of the first force arm opposite the second pivot. The handle section includes one or more handle bars to be engaged by an exercising person. Movement of the handle bars moves the first force arm against the load. Movement of the handle bars in one direction rotates the first force arm and the second force arm together about the first fulcrum. Such movement is accomplished by a pushing motion of the exercising person on the handle bar.

Movement of the handle bars in an opposite direction rotates the first force arm about the second fulcrum against the load. The first force arm rotates relative to the second force arm. Such movement is accomplished by a pulling motion by the exercising person.

In one embodiment the resistance load is provided at least partially by the body weight of the exercising person. A seat assembly is movably connected to the frame. A linkage connects the seat assembly to the first force arm in such a manner that the first force arm moves against the weight of the exercising person situated on the seat assembly. The connection point between the linkage and the first force arm is adjustable. This is effective to vary the load at the first force arm.

The angular position of the handle bar relative to the first force arm is adjustable. This adjustment permits convenient use of the machine by exercising persons of varying stature. It permits the exercising person to adjust the handle bar position so as to work different muscle groups. It permits adjustment of the handle bar to a position for leg exercises.

DESCRIPTION OF A PREFERRED EMBODIMENT

Figure 1:
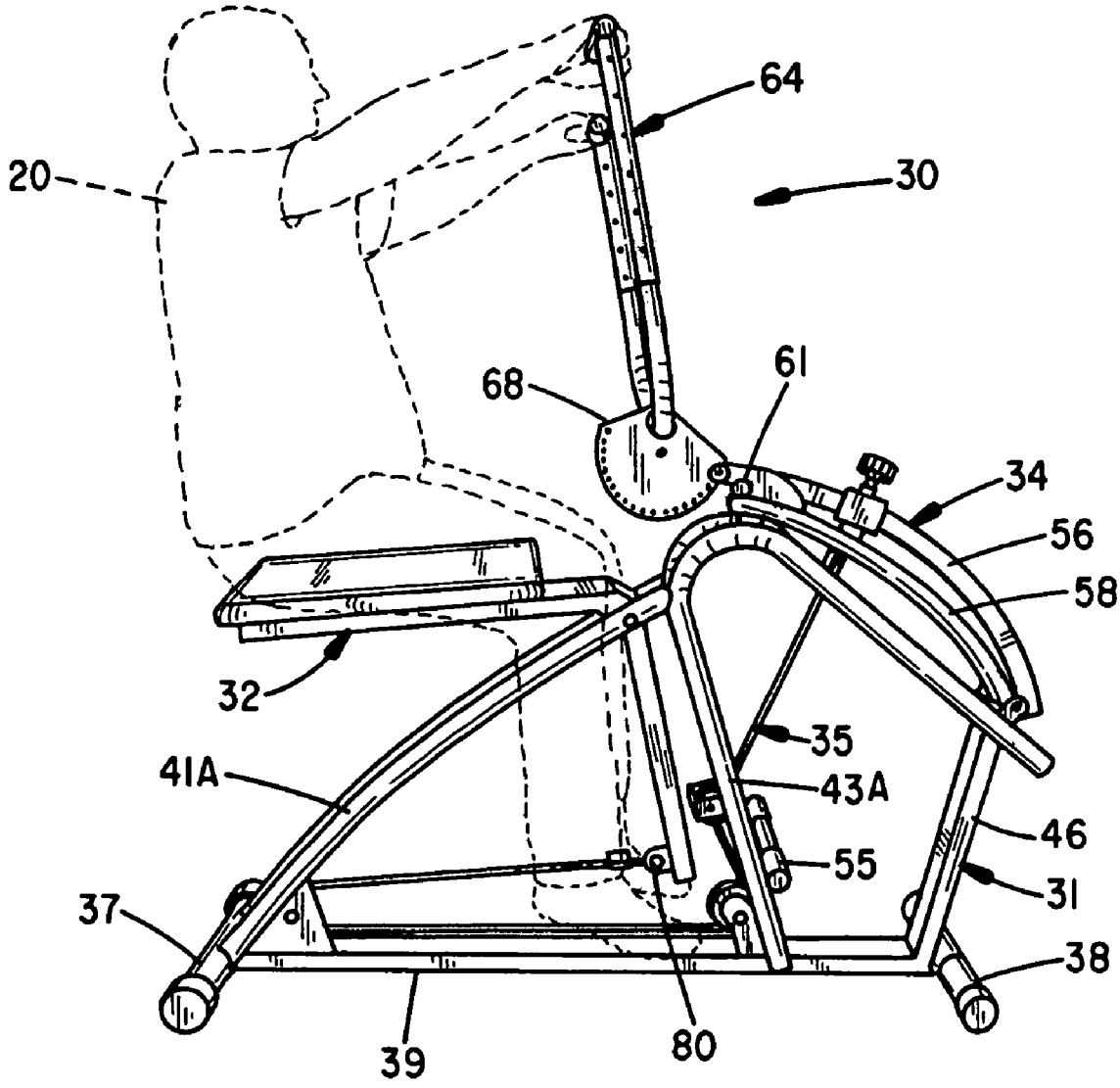
FIG. 1 is a side elevational view of an exercise machine according to one embodiment of the invention showing the dual fulcrum articulated force lever in a start or un-deflected position and showing an exercising person in phantom preparatory to commencement of an exercise routine.

Referring to the drawings there is shown in FIGS. 1 through 3 and 6 an exercise machine indicated generally at 30 is use by an exercising person indicated in phantom at 20. Exercise machine 30 includes a frame 31. A seat assembly 32 is connected to the frame toward one end thereof. A dual fulcrum articulated force lever 34 is connected to the frame toward the other end.

Frame 31 includes a longitudinal base member 39. Lateral feet 37, 38 are connected near the front and rearward ends of base member 39. Inclined parallel frame members 41A, 41B extend upward and forward from the rearward foot 37. Intermediate parallel upright frame numbers 43A, 43B connect to the rearward frame members 41A, 41B and to the base member 39. Forwardly inclined frame members 45A, 45B are joined to the upper ends of the intermediate frame members and extend to a forward brace 46. Forward brace 46 connects to the front end of the longitudinal base member 39.

Seat assembly 32 includes an L-shaped seat bar having a horizontal leg 49 and a vertical leg 50. The seat bar is hinged to frame 31 by a hinge connection 52. Hinge connection 52 includes a hinge bar 53 spanning the rear frame members 41. A load platform or seat 54 is fastened to the horizontal seat leg 49.

The dual fulcrum articulated force lever 34 includes a first force arm 56 and a second force arm 58. A first fixed end of the second force arm 58 is attached by a first pivot connection 59 to frame 31 at a first fulcrum 60. Fulcrum 60 is located at the front end of the frame 31. The first and second lever arms can pivot together about the first fulcrum 60. A first end of the first force arm 56 is connected by a second pivot connection 61 to the second movable end of the second force arm 58. In an un-deflected position of the second force arm 58 the second pivot connection 61 rests on a second fulcrum 62. Second fulcrum 62 is located aft of the first fulcrum.

A handle section 64 is fixedly connected to the first end of the first force arm opposite the second pivot connection 61. Pushing on the handle section in one direction results in rotation of the first and second force levers together about the first fulcrum. Pulling of the handle section in the other direction results in rotation of the first lever arm about the second fulcrum while the second lever arm is un-deflected.

Figure 10:
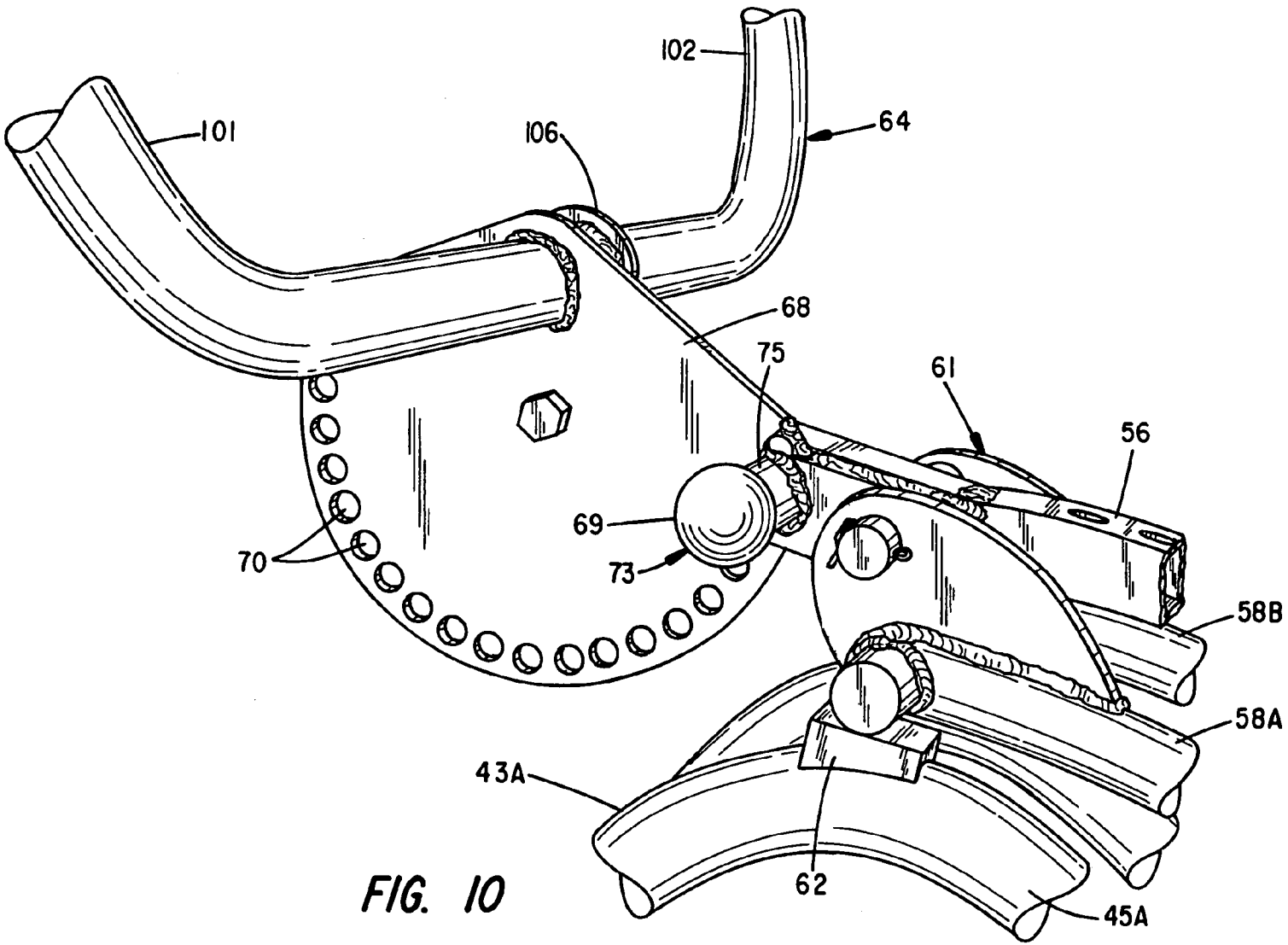
FIG. 10 is an enlarged side perspective view of the handle section angular adjustment mechanism.
Figure 11:
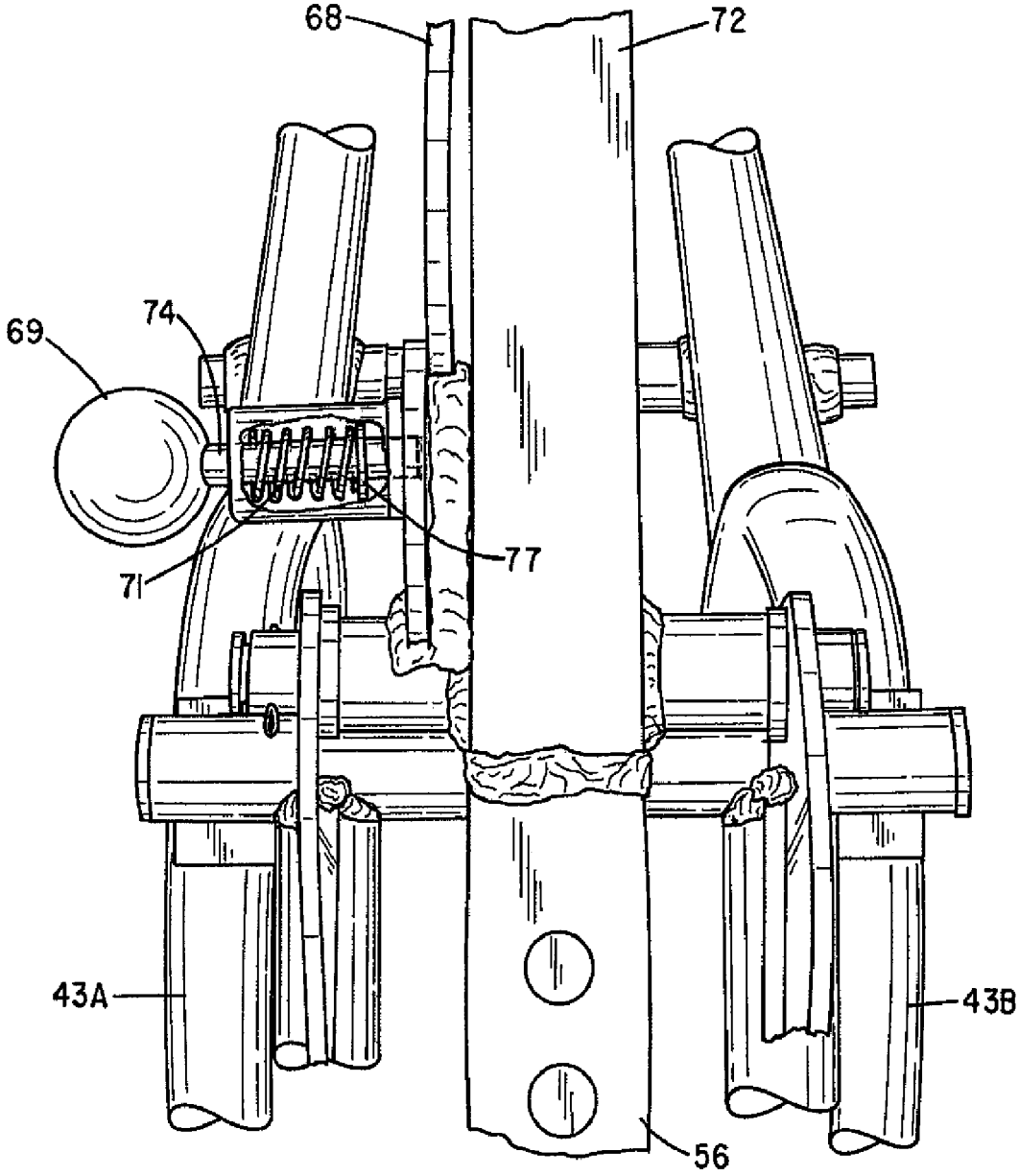
FIG. 11 is a view of the handle bar angular adjustment mechanism shown in FIG. 10 taken from an elevated position.

Force arms 56, 58 are arcuate in shape and lie parallel in the start position shown in FIG. 1. As shown in FIGS. 10 and 11 the angular orientation of the handle section 64 relative to the first force arm 56 is adjustable. Handle section 64 includes an adjustment plate 68. Adjustment plate 68 has an arcuate array of openings 70. First force arm 56 has an extension 72 opposite pivot 61. The plate 68 is connected to the extension 72 for positional adjustment. A spring-loaded locking pin assembly includes a locking pin 74 that is movable into and out of engagement with a selected one of the openings 70 through the use of a locking pin handle 69. A locking pin housing 75 is attached to extension 72 and contains an helical compression spring 71. Spring 71 acts between the housing 75 and a plate 77 on the locking pin to exert an inward force on the pin tending to retain it in engagement with the selected opening 70 on the adjustment plate. Retraction of locking pin 74 against the bias of spring 71 frees it from the selected opening 70 allows angular adjustment of the handle section 64 to another position.

Figure 4:
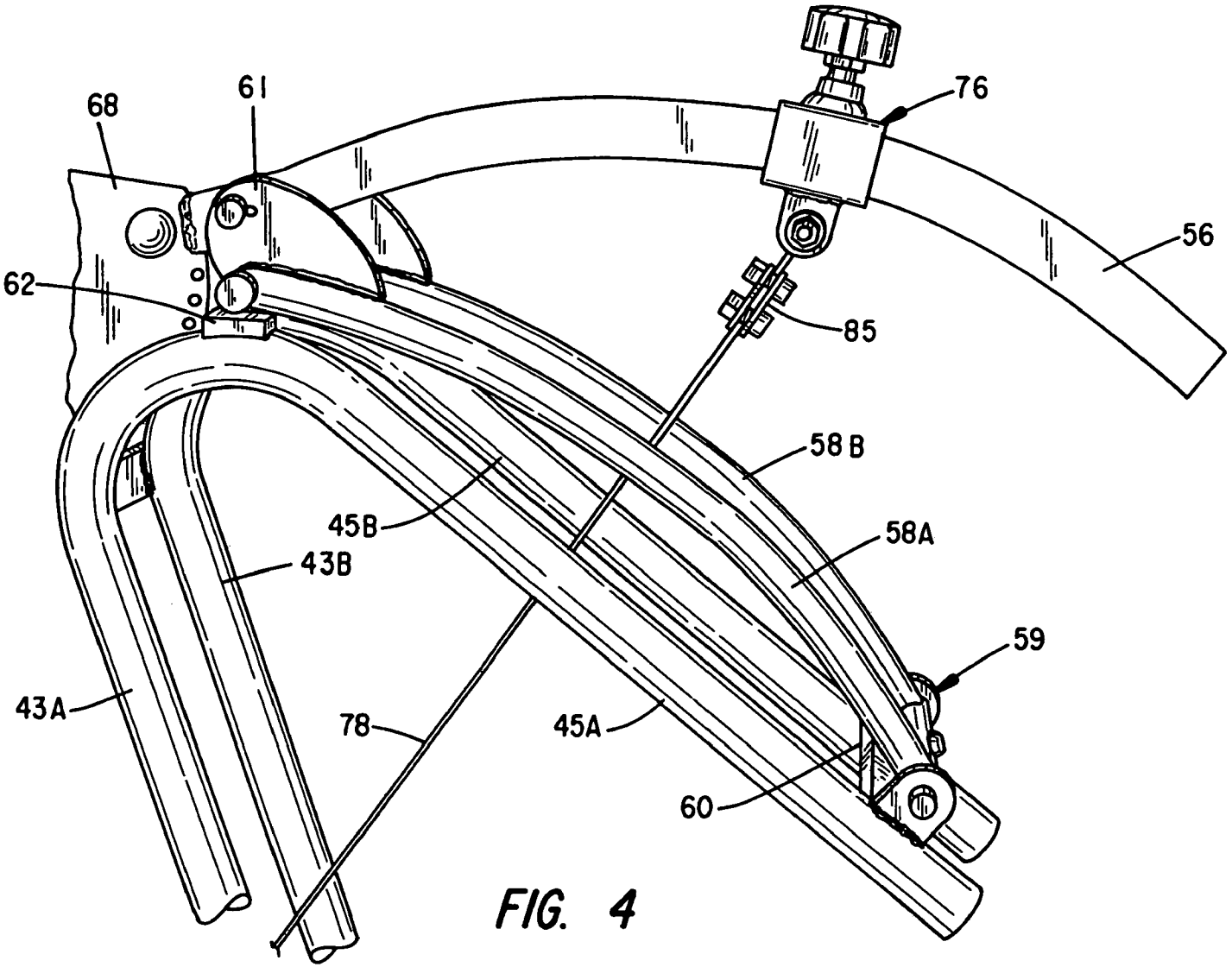
FIG. 4 is an enlarged view of the force lever in the deflected position shown in FIG. 2.
Figure 8:
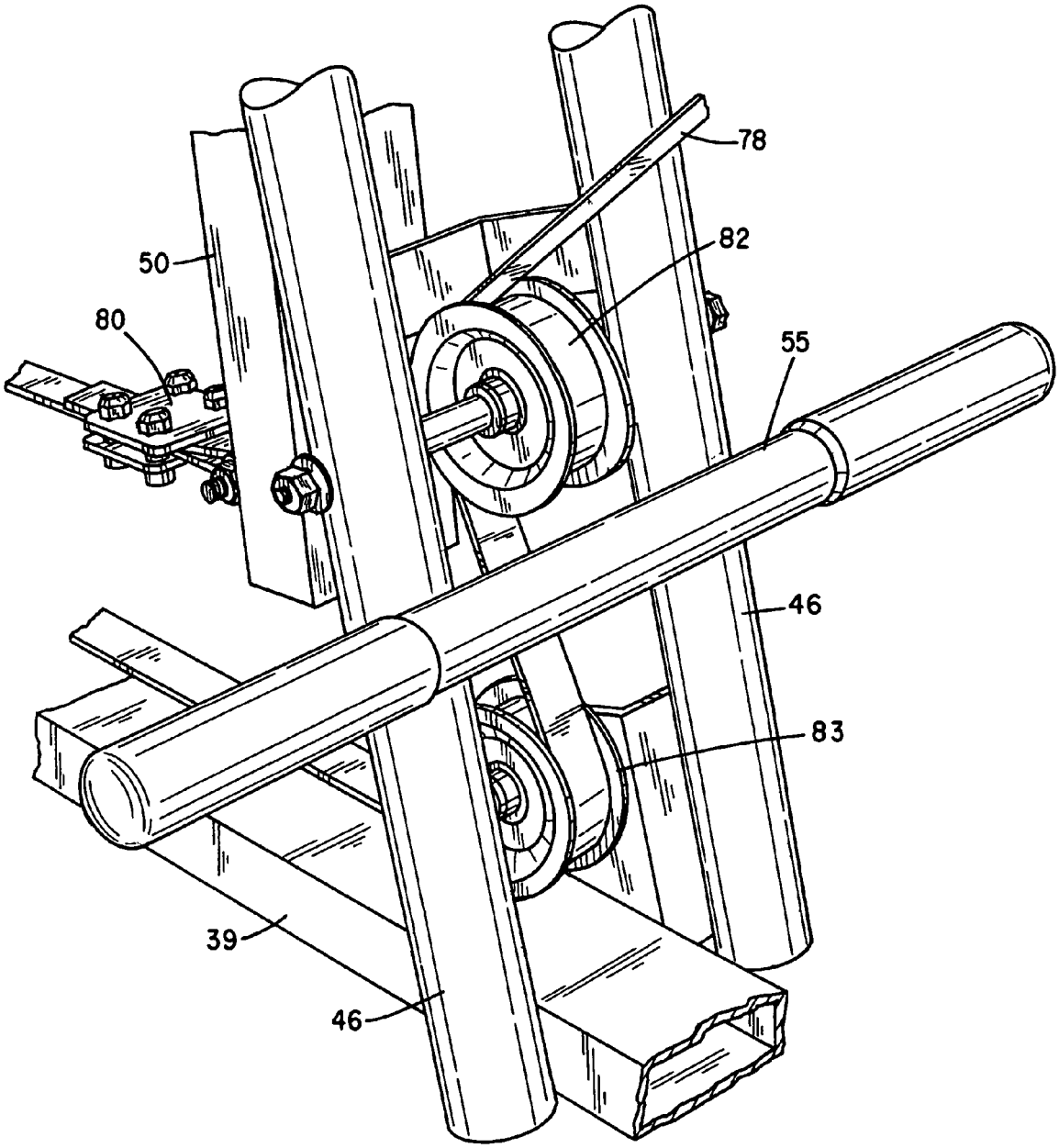
FIG. 8 is an enlarged view of a part of the load transmitting components of the tension linkage of the exercise machine.

In the embodiment shown an exercise load is provided at least partially by the weight of the exercising person occupying the seat 54. A load connection or tension linkage 35 connects first force arm 56 to the seat assembly 32. A tension strap 78 connects by a clip 85 at one end to a moveable clamp 76 installed on the first force arm 56. The other end of tension strap 78 connects to the vertical seat bar leg 50. The tension strap 78 is trained intermediately over first and second pulleys 82, 83 installed between the intermediate frame members 43A, 43B (FIG. 8). The tension strap extends from pulleys 82, 83 to a third pulley 84 installed between the rear frame members 41A, 41B. The tension strap extends from the third pulley to a clip 80 on the lower end of the vertical seat bar leg 50. Second force arm 58 has parallel spaced apart members 58A, 58B (FIG. 4). The tension strap 78 passes between the parallel members 58A, 58B of the second force arm 58. Through this load transmission linkage the weight of a person on seat 54 transmits a tension load at clamp 76 and accordingly on first lever arm 56.

Figure 9:
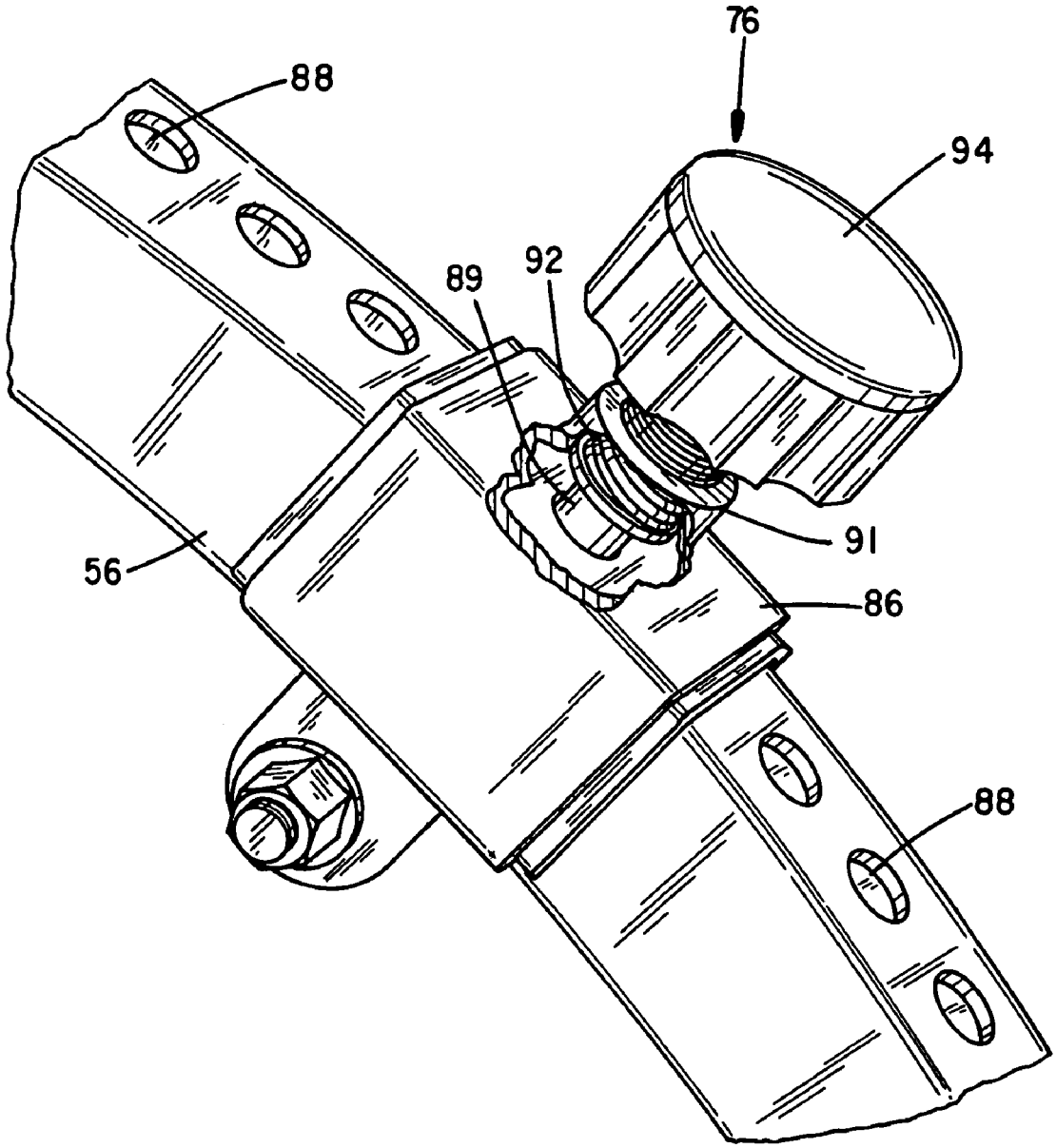
FIG. 9 is an enlarged view of the load varying mechanism of the articulated dual fulcrum force lever of the exercise machine.

The position of clamp 76 on the first force arm 56 is adjustable for the purpose of varying the amount of the exercise load. As shown in FIG. 9, the particular clamp 76 illustrated includes a positionally adjustable clamp block 86 installed on first force are 56. Spaced apart openings 88 are located along the top surface of the force arm 56. Clamp block 86 has a locking-pin assembly including a spring-loaded pin 89 assembled in a pin housing 91 on clamp block 86. A compression spring 92 holds the pin 89 engaged in a select opening 88 according to the desired position. A knob 94 is connected to the outer end of the pin 89. Pulling on the knob 94 is effective to disengage the pin 89 from the opening 88 and permit adjustment of the position of the clamp block 86 to another opening. Other suitable types of clamp can be used to connect the load to the first force lever.

Figure 1A:
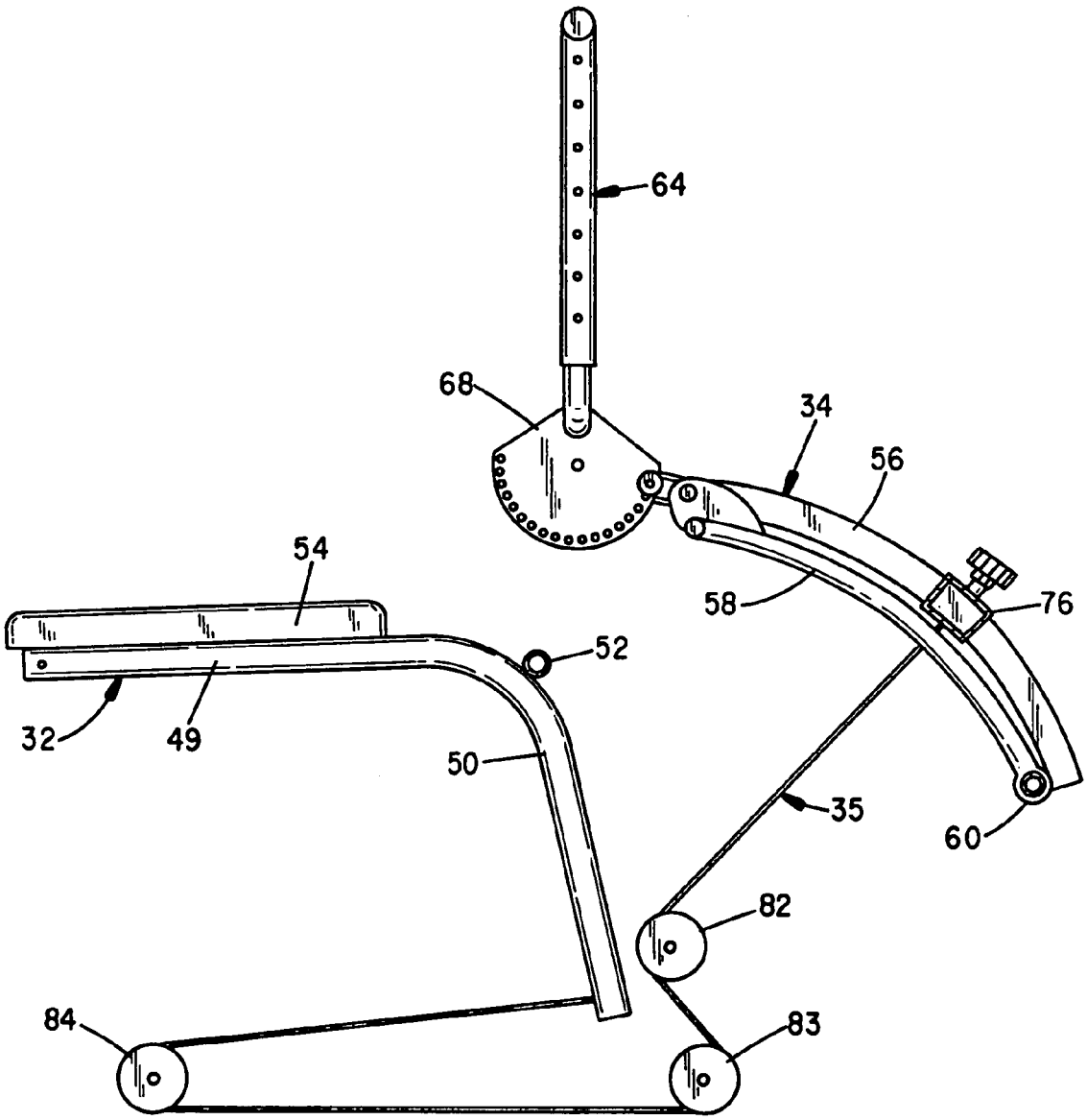
FIG. 1A is a schematic drawing depicting the articulated force lever and the seat assembly of the exercise machine along with the tension linkage connecting them.

The free body diagram of FIG. 1A shows that the arc described by first force arm 56 has a center at approximately the center of the first pulley 82. As the clamp 76 is moved along the length of the force arm 56, the length of the segment of tension strap 78 between the first pulley 82 and the clamp 76 remains substantially constant whereby the orientation of the seat 54 does not change by virtue of the clamp position adjustment. The orientation of the seat 54 is independent of the position of the clamp 76 along the length of the force arm 56.

Figure 2:
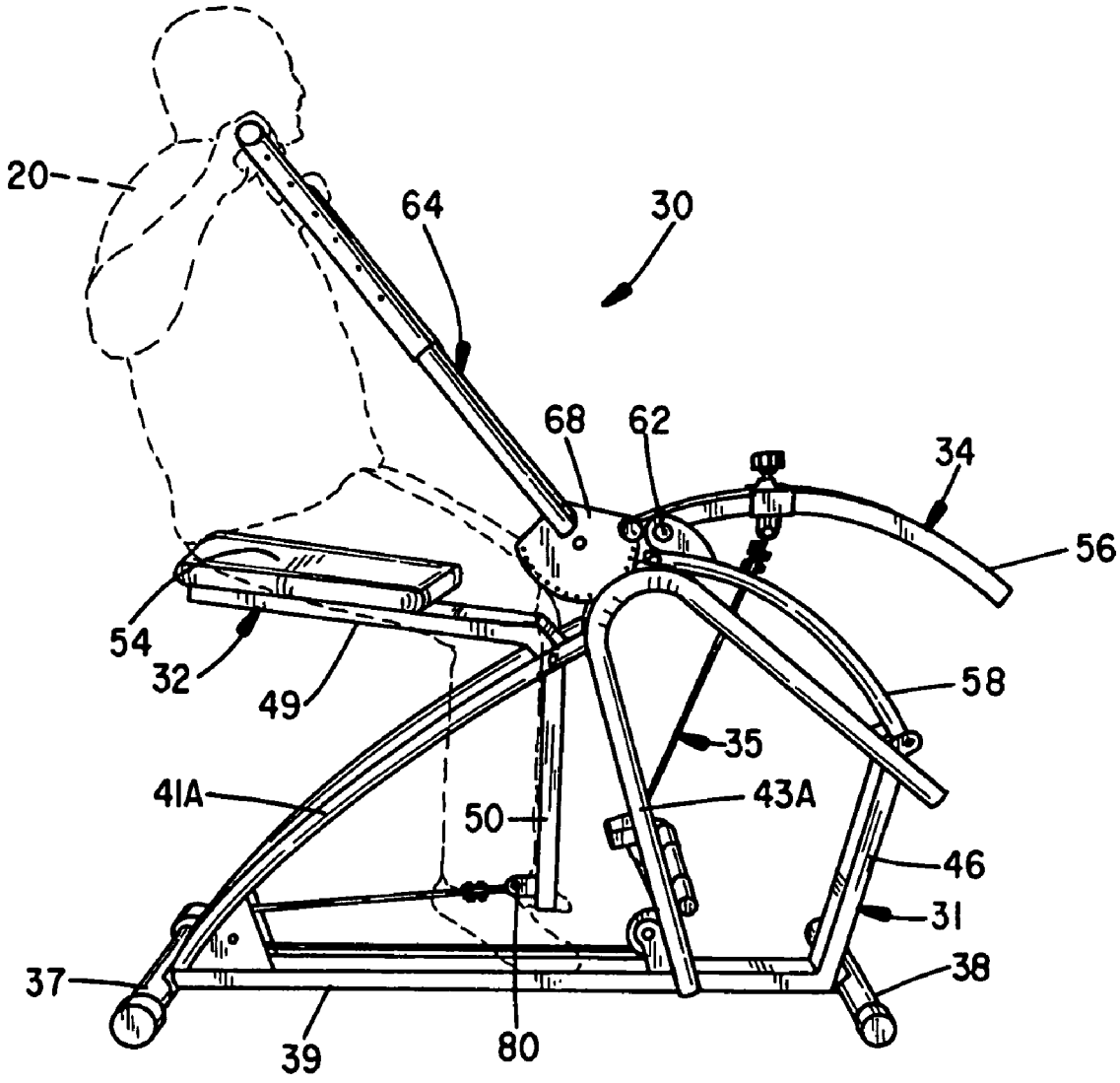
FIG. 2 is a side view of the exercise machine showing the force lever in a position deflected from the start position in a first direction during an exercise routine involving pulling on the handle bars by the exercising person.

In use of the exercise machine in FIG. 1 an exercising person 20 occupies seat 54 preparatory to engaging in an exercise routine. The exercising person may or may not rest the feet on the foot bar 55 provided for that purpose. The dual fulcrum articulated force lever 34 is in an un-deflected or start position. In one exercise regimen the exercising person 20 pulls on the handle 64 as shown in FIG. 2. In doing so the first force arm 56 rotates about the second fulcrum 62. The first force arm 56 deflects away from the frame 31 and from the second force arm 58. The second force arm is un-deflected. Clamp 76 moves upward pulling on the tension strap 78. This pulls on the vertical leg 50 of the seat bar whereby the exercising person is pulling against his or her own weight as the seat bar pivots about the seat pivot 52.

The position of the clamp 76 on the force arm 56 regulates the amount of load at the handle bar section 64. As viewed in FIG. 4, movement of the clamp position from left to right or away from the second fulcrum 62 results in greater load encountered at the handle bar section 64 in a pulling routine.

Figure 3:
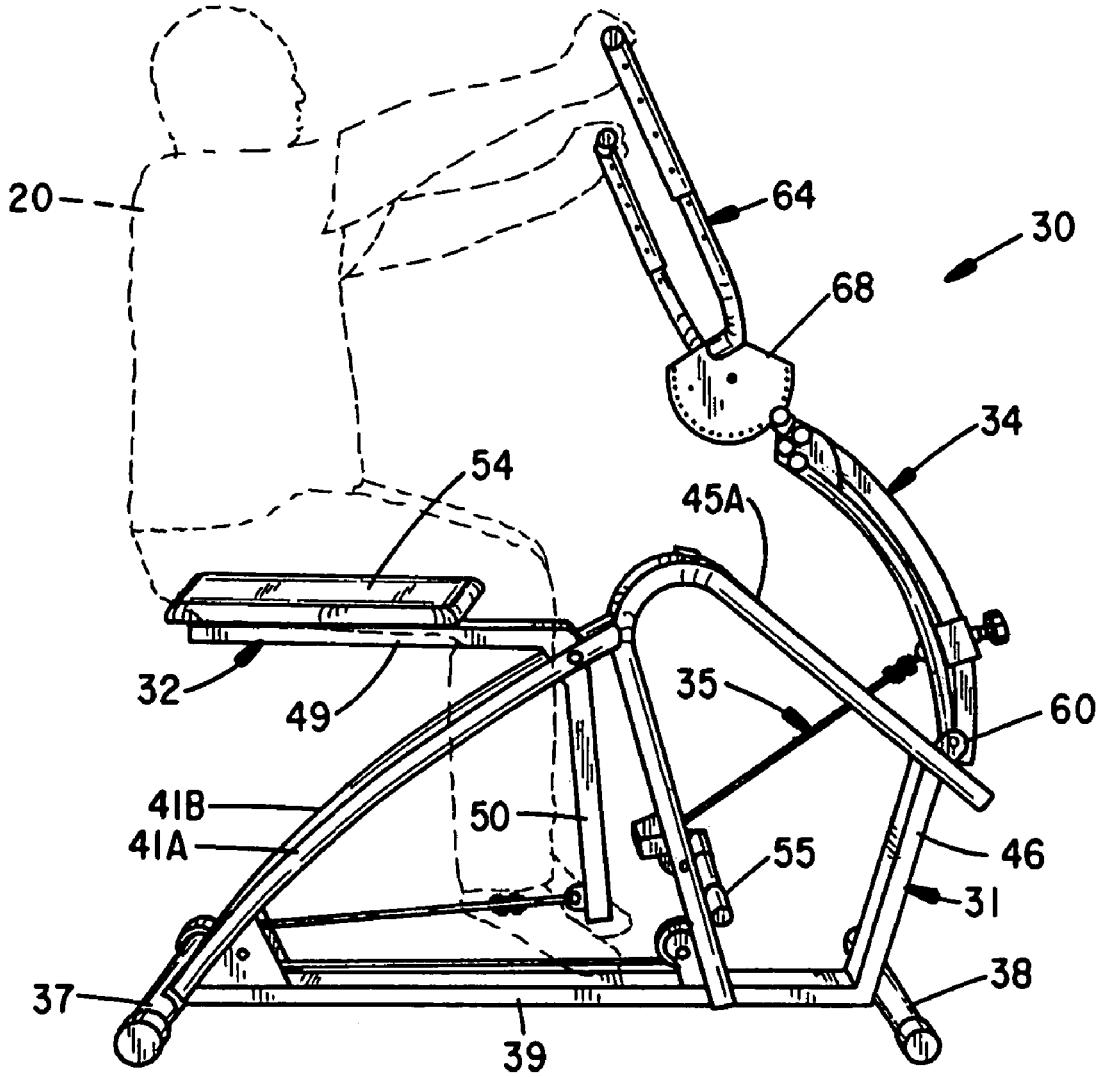
FIG. 3 is a side elevational view of the exercise machine showing the force lever in a position deflected from the start position in a second direction during an exercise routine involving pushing on the handle bars by the exercising person.
Figure 5:
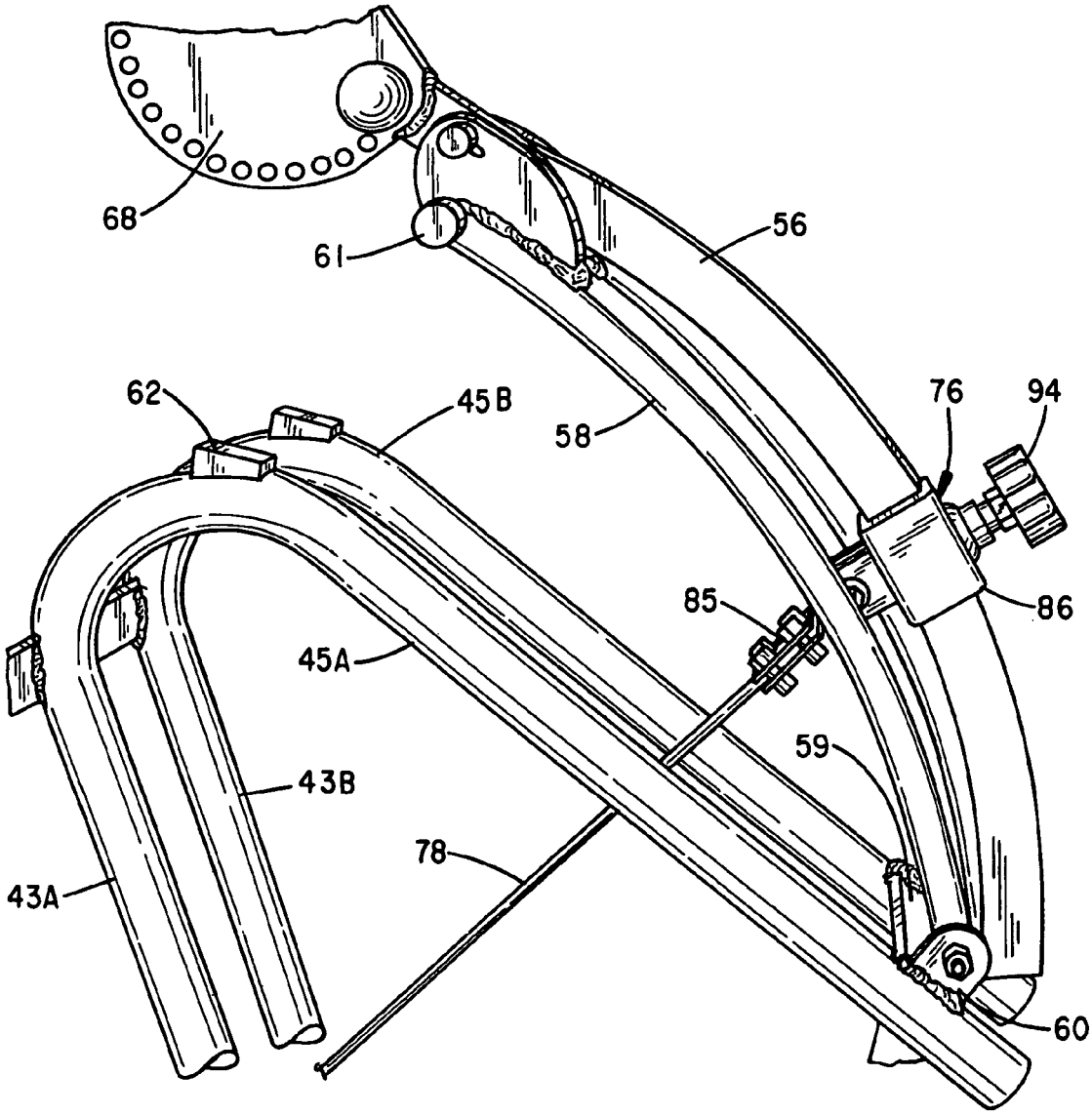
FIG. 5 is an enlarged view of the force lever in the deflected position shown in FIG. 3.

In FIG. 3 the exercising person 20 is shown occupying seat 54 and engaging in a pushing or lifting type exercise. The exercising person 20 pushes on the handle section 64 resulting in the deflection shown in FIGS. 3 and 5. The force arms 56, 58 rotate together about the first fulcrum 60. The rotational movement is against the tension on the tension strap 78 as clamp 76 moves away from the frame and pulls on the seat bar.

The clamp 76 is adjustable along the length of the first force arm 56 to vary the amount of load experienced at the handle section 64 during the pushing regimen. As viewed in FIG. 5 movement of the clamp from right to left or in a direction away from the first fulcrum 60 results in increasing load.

Figure 6:
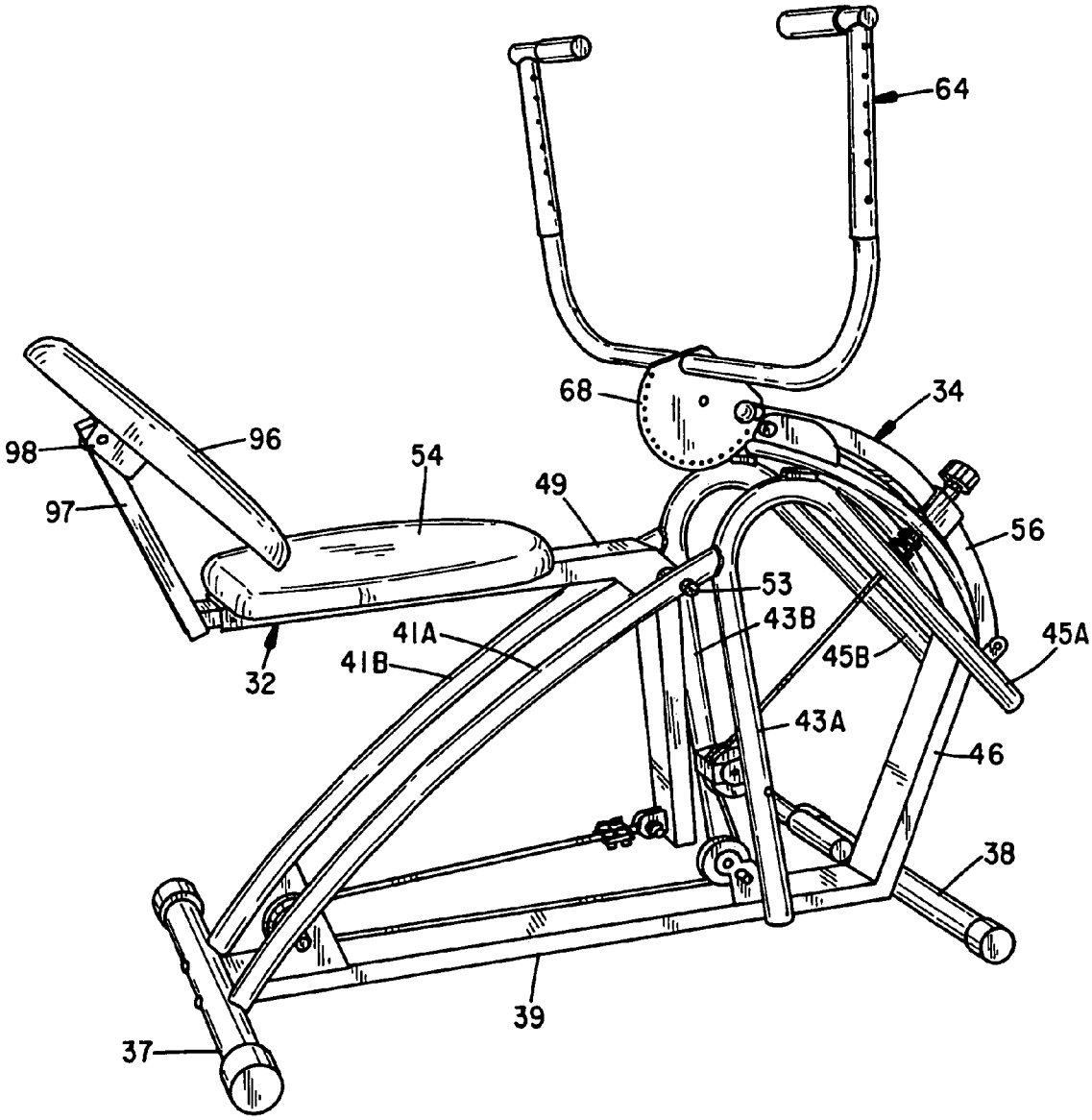
FIG. 6 is a perspective view of the exercise machine showing a seat back installed.

FIG. 6 shows an adjustable and removable seat back. A seat back 96 is mounted to an L-shaped seat back support 97 by a bracket 98. A horizontal section of the seat back support 97 telescopes into the open end of the horizontal leg 49 of the seat bar. A pivotal connection of the seat back 96 to the bracket 98 allows it to be positioned between an inclined orientation as shown in FIG. 6 or a more upright orientation. The seat back assembly is held in place by a suitable pin connection so that it can be readily removed.

Figure 7:
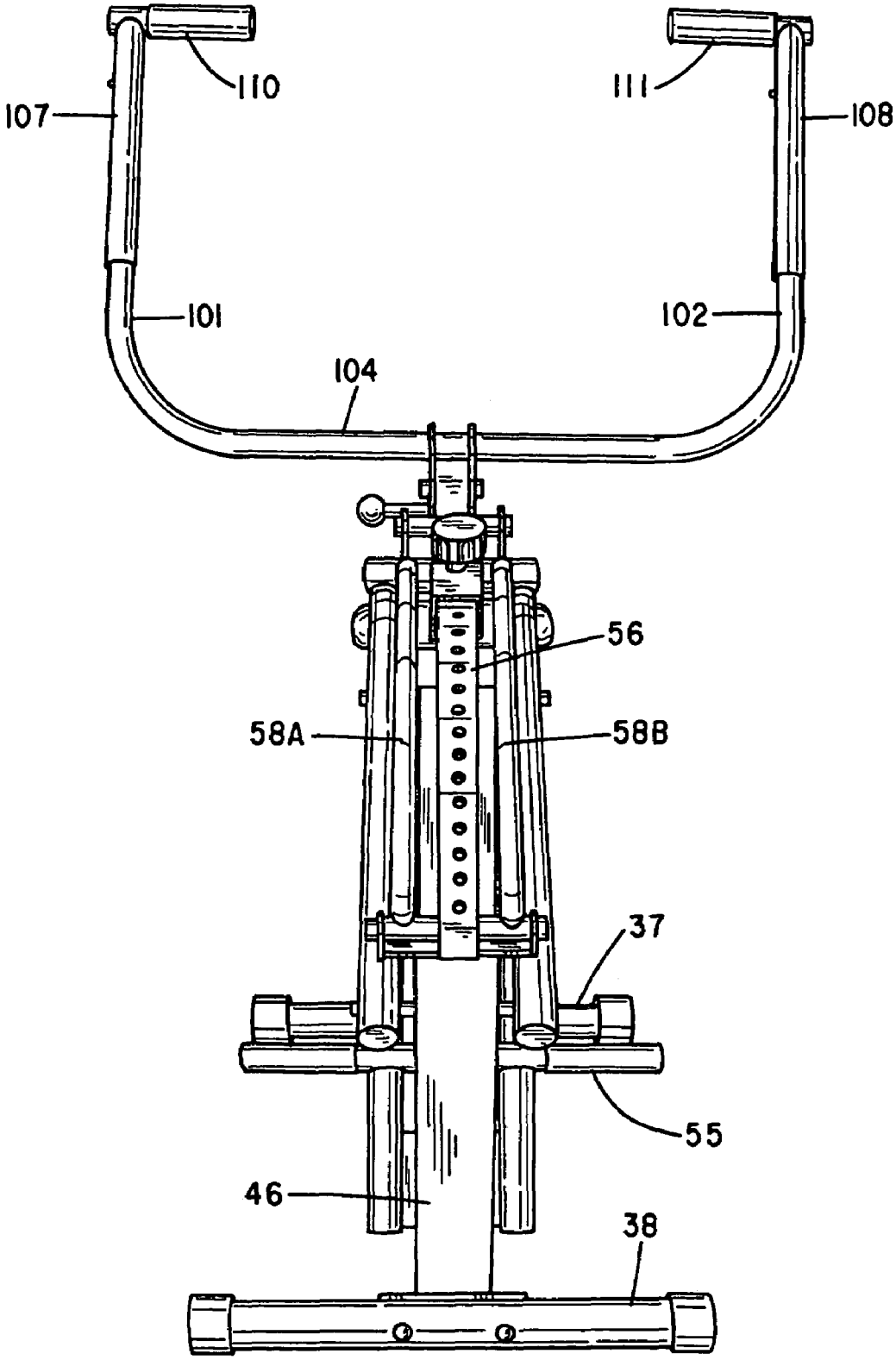
FIG. 7 is a front view of the exercise machine.
Figure 12:
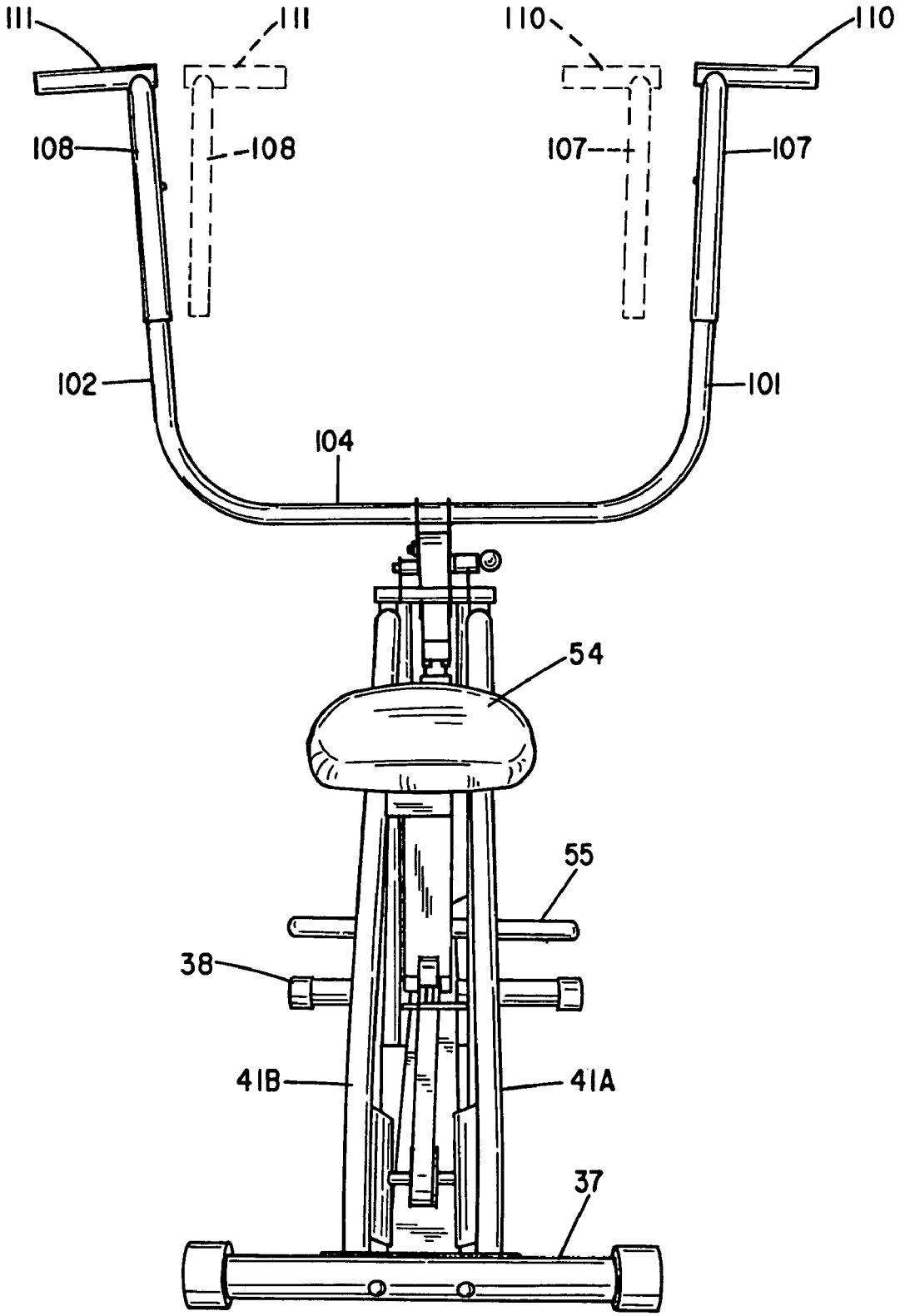
FIG. 12 is a rear view of the exercise machine.

The handle bar section 64 has parallel handle bars 101, 102 connected by a cross-bar 104 assembled in a bracket 106 connected to adjustment plate 68 (see FIGS. 10 and 12). As shown in FIGS. 7 and 12 the handle bars 101, 102 have telescopic end sections 107, 108. The end sections 107, 108 are moveable with respect to stationary portions of the bars 101, 102 to vary the length thereof. The end sections 107, 108 are held in place by known push button detent mechanisms (see FIG. 6). Grips 110, 111 are located at the outer ends of the bar extensions 107, 108. The handle bars 101, 102 can be extended or retracted in length by adjustment of the end sections 107, 108. Additionally, the end sections 107, 108 can be rotated 180° on the arms 101, 102 as shown in phantom in FIG. 12.

The position of the handle bar section 64 is adjusted relative to the first force arm through the adjustment plate 68 according to the stature and comfort of the exercising person and the type of intended exercise such as a pushing or lifting type routine or a pulling routine. Additionally the handle section can be rotated to a downward position with the grips 110, 111 positioned near the feet of the exercising person for engaging in leg exercises.

The invention claimed is:

1. An exercise machine comprising:

a frame;

an articulated force lever having a first force arm and a second force arm;

a first end of the second force arm pivotally connected to the frame at a first pivot connection for rotation about a first fulcrum;

a second pivot connection connecting the second force arm to a first end of the first force arm;

a second fulcrum on the frame;

said second force arm rotatable about the first pivot connection to the second fulcrum;

a handle section connected to the first end of the first force arm opposite the second pivot;

a load connected to the first force arm between the first and second ends whereby movement of the handle section in a first direction rotates the first and second force arms about the first pivot against the resistance of the load, movement of the handle section in a second direction rotates the first force arm about the second pivot against the resistance of the load, and where the position where the load is connected to the first force arm is adjustable;

a load linkage connected at a first end to a load, where said load linkage is connected at a second end to the first force arm, the position where the load linkage is connected to the first force arm is adjustable to vary the load, and the load linkage is a tension strap;

a seat assembly including a seat bar pivotally connected to the frame;

a seat connected to the seat bar;

said load linkage connected to the seat bar whereby the load is provided at least partially by an exercising person occupying the seat;

said first force arm is arcuate;

a pulley installed on the frame between the first force arm and the seat bar;

said tension strap extending from the first force arm and over the pulley to the seat bar; and said pulley located at approximately the center of the arc of the first force arm.

2. The exercise machine of claim 1 including:

an array of openings along the surface of the first force arm;

a movable clamp installed on the first force arm;

said tension strap connected to the movable clamp;

said movable clamp having a locking pin movable into and out of engagement with a selected opening on the first force arm to permit adjustment of the position of the connection of the tension strap with the first force arm.

3. The exercise machine of claim 2 wherein:

the locking pin of the movable clamp is spring loaded.

* * * * *